United States Patent [19]

Sowell

[11] Patent Number: 4,707,896

[45] Date of Patent: Nov. 24, 1987

[54] CRIMPER DISCHARGE REGULATION

[75] Inventor: Lyles H. Sowell, Old Hickory, Tenn.

[73] Assignee: E. I. Du Pont de Nemours and Company, Wilmington, Del.

[21] Appl. No.: 927,593

[22] Filed: Nov. 5, 1986

[51] Int. Cl.[4] ..... D02G 1/12

[52] U.S. Cl. ..... 28/250; 28/263

[58] Field of Search ..... 28/221, 250, 255, 263, 28/264

[56] References Cited

U.S. PATENT DOCUMENTS

| | | | |
|---|---|---|---|
| 2,514,557 | 7/1950 | Pfau . | |
| 3,231,958 | 2/1966 | Chadwick . | |
| 3,234,626 | 2/1966 | Faria | 28/221 |
| 3,241,213 | 3/1966 | Thompson, Jr. et al. | 28/263 |
| 3,345,719 | 10/1967 | Schatz et al. . | |
| 3,406,436 | 10/1968 | Clarke, Jr. | 28/250 |
| 3,553,802 | 1/1971 | Stanley . | |
| 3,639,955 | 2/1972 | Fleissner et al. . | |
| 3,800,373 | 4/1974 | Fleissner . | |
| 3,859,695 | 1/1975 | Erickson | 28/250 |
| 4,547,934 | 10/1985 | Ford . | |

*Primary Examiner*—Robert R. Mackey

[57] ABSTRACT

A gate/loading arrangement which balances applied gate force betweem the edges of tow being crimped in a stuffer box crimper. A single hinged gate has been replaced with two or three equal sized gates and force is applied to the gates from an air cylinder through a pivotal linkage.

9 Claims, 2 Drawing Figures

CRIMPER DISCHARGE REGULATION

BACKGROUND OF THE INVENTION

This invention relates to stuffer box crimping of yarn, and more particularly, it relates to a method and apparatus for controlling crimp.

Stuffer box crimpers are well known and have been widely employed for crimping filament strands, including for example, yarns, tows and threads.

In the case of tow, formed of several ropes of yarn, crimp level is controlled by the amount of force applied to the tow band by a single hinged gate associated with the outlet of the crimping chamber. A problem may arise because the thickness of the tow band entering the crimper varies across the width of the band due to interactions between the ropes which make up the tow.

The two edges of the tow band experience the greatest variations due to contact with guides employed to position the tow band ahead of the crimper. While one edge may be consistently thicker than the other, a more common occurrence is the periodic thickening of one edge with a simultaneous thinning of the opposite edge. Either of these conditions results in poor crimp uniformity across the tow band width. In severe cases operability (crimper jams) becomes a major problem. This occurs when the thick edge carries most of the gate force causing the thin edge to become slack.

SUMMARY OF THE INVENTION

An improved process and apparatus has been developed which continuously balances the applied gate forces between the edges of the tow being crimped. The single hinged gate is divided into a plurality of hinged gates and any unequal force applied to the gates due to variations in the thickness of the tow exiting the crimping chamber is balanced by transferring forces between the gates by means of a pivoting linkage located between the gates and the source of force applied to the gates.

The gate arrangement may be a double or triple gate arrangement.

Figure 1:
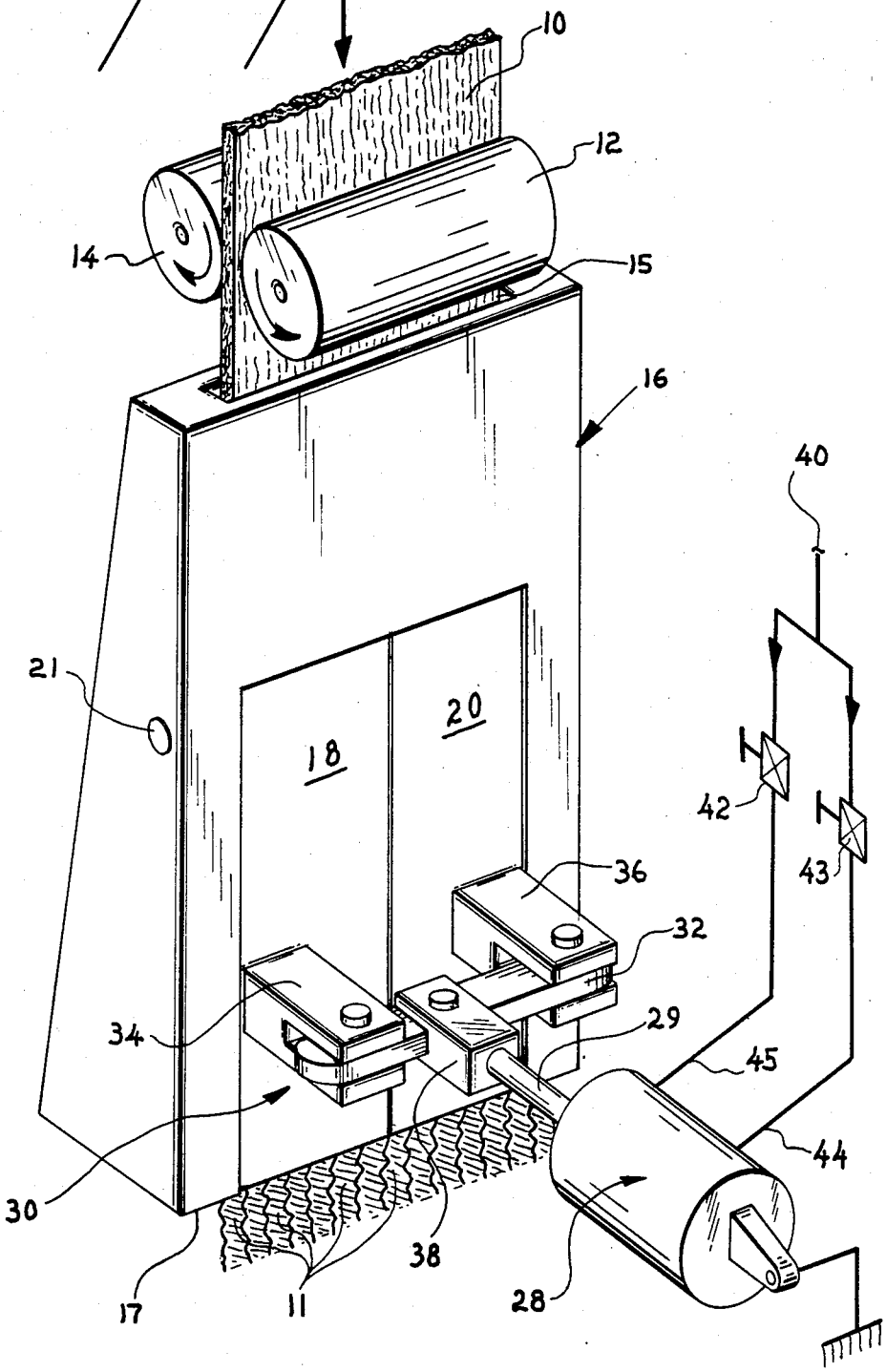
FIG. 1 is a perspective view of one embodiment of the invention with two hinged gates.
Figure 2:
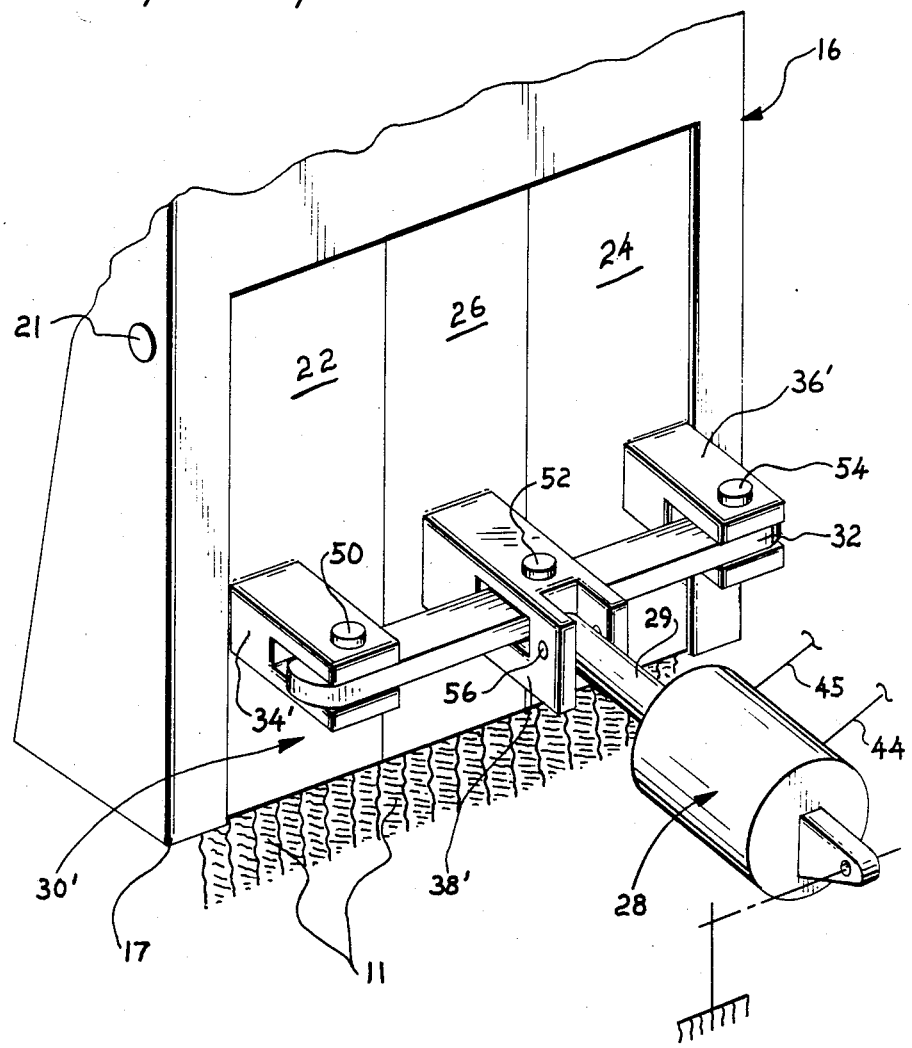
FIG. 2 is a perspective view of another embodiment of the invention with three hinged gates.

Referring to the drawings, a continuous tow 10 is fed by means of rollers 12, 14 into the inlet 15 of stuffer box 16 comprising a crimping chamber and a regulation means at the outlet 17 of the stuffer box in the form of two gates 18, 20 of equal size hinged to stuffer box 16 via pin 21 (FIG. 1) or three equal sized hinged gates 22, 24, 26 (FIG. 2).

In FIG. 1, an air cylinder 28 applies a force as desired through pivoting linkage 30 against gates 18, 20. The pivoting linkage 30 includes a bar 32 and pin supports 34, 36, 38 fixed to gate 18, gate 20 and cylinder rod 29, respectively. Bar 32 is loosely pinned at its ends in pin supports 34, 36 and at its center in pin support 38 attached to cylinder rod 29. Air cylinder 28 is a double acting cylinder which applies pressure through rod 29 against gates 18,20 through linkage 30. Compressed air is supplied from a source indicated by arrow 40 through pressure control valves 42, 43 via pipes 44, 45 to cylinder 28.

In operation, the pressure is manually set at the top of cylinder 28 by adjusting controller 43, and at the bottom of cylinder 28 by controller 42, then as either gate 18 or 20 is forced open by tow 10 which has a thicker than normal portion along its edge, the reaction force applied to the gate will be transferred via the pivoting bar 32 to the other gate. This results in a more uniform application of gate loading to both halves of the tow regardless of thickness. The crimped tow 11 emerging from the stuffer box 16 falls into a collection means (not shown).

In FIG. 2, like elements are numbered the same as in FIG. 1 and in this embodiment three gates are used, i.e., 22, 24, 26 and the pivoting linkage is constructed to have pin supports 34', 36', and 38' fixed to gates 22, 24 and 26, respectively. The bar 32 is loosely pinned at its ends to pin supports 34' and 36' and at its center to pin support 38', by pins 50, 54, 52, respectively. The air cylinder rod 29 is pinned to pin support 38' by means of loosely fitted pin 56.

This embodiment with three gates, hinged at pin 21 which passes through stuffer box 16, has the ability to give more or less loading to the side gates 22, 24 versus the center gate 26 by shifting the relative location of pins 50 and 54 with respect to pin 52.

For example, if more loading is desired on gates 22, 24 than on gate 26 then locations of pins 50, 54 relative to location of pin 52 would be placed to position gates 22, 24 forward of gate 26. Conversely, if less force is desired on gates 22, 24 than on gate 26, locations of pins 50, 54 relative to pin 52 would be placed to position gates 22, 24 behind gate 26.

In a series of runs on four different polyester products fed into a stuffer box crimper under substantially similar conditions for each product, a comparison of crimp uniformity using a single hinged gate versus two hinged gates (FIG. 1) was made using the standard deviation (means square of successive differences) of the crimps per inch. The results are shown in the table below.

| Product | | Standard Deviation | |
|---|---|---|---|
| Denier/filament | Du Pont Type Polyester | Single gate | Two gates |
| 12.0 | 776 | 0.884 | 0.766 |
| 12.0 | 768 | 0.695 | 0.596 |
| 3.0 | 35 | 0.744 | 0.695 |
| 1.5 | 811 | 1.061 | 0.875 |

In each case, the standard deviation of crimps per inch for the two gate arrangement is less than that of the single gate thus confirming a more uniform level of crimp.

I claim:

1. In a stuffer box crimping process in which yarn is forced into a crimping chamber and the outlet of the chamber is provided with a single hinged gate having force applied thereto by fluid pressure means, the improvement of which comprises: dividing said single gate into a plurality of hinged gates positioned side-by-side across the width of said outlet and balancing any unequal force applied to said gates due to variations in thickness of yarn exiting said outlet by transferring force among gates by means of a linkage connected between said gates and said fluid pressure means.

2. The method of claim 1 wherein said gate is divided into two hinged gates of equal size.

3. The method of claim 1 wherein said gate is divided into three hinged gates of equal size.

4. A yarn crimping apparatus comprising a crimping chamber having an inlet and an outlet;

means located adjacent the inlet of the crimping chamber for forcing yarn into the chamber;

a plurality of hinged gates in a side-by-side relationship associated with the outlet of the crimping chamber to regulate the discharge of yarn from the chamber;

means for applying force to said gates; and means for balancing any unequal force applied to said gates due to variations in the thickness of the yarn exiting the outlet of the crimping chamber.

5. The apparatus of claim 4, wherein said means for balancing any unequal force due to variations in thickness of the yarn exiting the outlet of the crimping chamber is a pivoting linkage connected between said hinged gates and said means for applying force to said gates.

6. The apparatus of claims 4 or 5 wherein there are two gates.

7. The apparatus of claim 6 wherein said gates are of equal size.

8. The apparatus of claims 4 or 5 wherein there are three gates.

9. The apparatus of claim 7 wherein said gates are of equal size.

* * * * *